US006983742B2

(12) United States Patent
Jordan et al.

(10) Patent No.: US 6,983,742 B2
(45) Date of Patent: Jan. 10, 2006

(54) COLLAPSIBLE TOY AIR GUN

(75) Inventors: Brian Jordan, Hollywood, MD (US); Steven Zuloff, Chatsworth, CA (US)

(73) Assignee: CYI, Inc., Chatsworth, CA (US)

( * ) Notice: Subject to any disclaimer, the term of this patent is extended or adjusted under 35 U.S.C. 154(b) by 106 days.

(21) Appl. No.: 10/439,885

(22) Filed: May 16, 2003

(65) Prior Publication Data

US 2004/0226548 A1 Nov. 18, 2004

(51) Int. Cl.
*F41B 11/24* (2006.01)

(52) U.S. Cl. ..... 124/56

(58) Field of Classification Search ..... 124/55
See application file for complete search history.

(56) References Cited

U.S. PATENT DOCUMENTS 2,614,551 A * 10/1952 Shelton ..... 124/55
2,628,450 A * 2/1953 Shelton ..... 446/24
2,828,579 A * 4/1958 Schwerberl et al. ..... 446/19
2,846,996 A * 8/1958 Drynan ..... 124/55
2,855,714 A * 10/1958 Thomas ..... 42/57
2,879,759 A * 3/1959 Webb ..... 124/55
3,117,567 A * 1/1964 Allen, Jr. ..... 124/55
3,342,171 A * 9/1967 Ryan et al. ..... 124/55
4,157,703 A * 6/1979 Brown et al. ..... 124/55
5,337,726 A * 8/1994 Wood ..... 124/61

* cited by examiner

*Primary Examiner*—Michael J. Carone
*Assistant Examiner*—Troy Chambers
(74) *Attorney, Agent, or Firm*—Howard C. Miskin; Gloria Tsui-Yip

(57) ABSTRACT

A collapsible toy air gun with at least two tapered tubular sections adapted to be cooperatively joined coaxially, at least one supporting plate, a diaphragm and a resilient string. The tapered tubular sections are correspondingly sized concentrically to form a tubular body having a larger and an opposite smaller opening end in the extended operational position. At least one supporting plate is mounted on the circumferential surface of the tubular body to maintain the tubular sections in the extended position. The diaphragm is mounted transversely across the larger opening end of the tubular body with a pull knob and back support secured to the diaphragm. The resilient string is mounted across the smaller opening end of the tubular body through the back support.

31 Claims, 5 Drawing Sheets

COLLAPSIBLE TOY AIR GUN

FIELD OF THE INVENTION

The invention relates to an entertainment device for adults and children and specifically, a toy air gun. In particular, a toy air gun is disclosed that is collapsible, easy to ship, assemble, use and manufacture.

BACKGROUND OF THE INVENTION

Toy guns are common with children and provide excitement of playing out the hunting and the hunted or shooting targets. Traditional toy gun resembles a real gun and projects a fake bullet at relatively high speed. This type of toy gun is very dangerous to play with as the projectile can severely injure a child, in particular, his/her eyes. Furthermore, bullets are often lost after shooting from the gun and require constant replenishment or reloading.

In view of the increase in gun violence in today's society, traditional toy guns have been considered politically incorrect and parents minimize their children's exposure to toy guns. Due to the decrease in popularity of toy guns with a projectile, toy water guns have increased their popularity in recent years.

Prior art toy water gun uses water and projects a squirt or stream of water. Toy water gun is slightly less dangerous to play with and does not cause severe injury, but does cause a mess if used indoors. Similar to a traditional toy gun that projects a fake bullet, the water ammunition is lost after shooting and requires constant refill. Furthermore, water toy gun is very messy and essentially played outdoors only.

Another type of safe toy gun is one that shoots a ball or wave of air. A toy air gun is advantageous over traditional and water toy guns because it is safe to play with, does not cause severe injury, no need to refill ammunition during play and it is not messy to use.

Prior art toy air guns generally use a resilient diaphragm that is drawn and cocked rearward and released (e.g. U.S. Pat. Nos. 4,157,703, 2,846,996 and 2,614,551) or is struck with a hammer (e.g. U.S. Pat. No. 3,117,567) to provide a puff of air at relatively high velocity to be felt many feet away. Disadvantageously, all prior art air toy guns have bulky constructions due to the many intricate parts that make up the toy guns and are expensive to manufacture and ship due to their sizes.

Therefore, there is a need for a toy air gun that is inexpensive to manufacture, easy to use, ship and assemble.

SUMMARY OF THE INVENTION

The present invention provides a toy air gun having a collapsible feature to facilitate shipping and assembly and is inexpensive to manufacture and easy to use.

The toy air gun of the present invention comprises at least two corresponding tapered tubular sections and at least one supporting plate. The tapered tubular sections are correspondingly sized concentrically such that in the extended cooperative, co-axial position, the tubular sections form a tapered tubular body having a total axial length of the combined axial lengths of the tubular sections. Mounted transversely across the larger opening end of the tubular body is a non-resilient, non-porous diaphragm. A pull knob and a back support securely sandwich the diaphragm near the center of the diaphragm. A resilient string is mounted across the smaller opening end of the tubular body, with a section of the string looping through an opening adjacent the back support. The supporting plate has at least two latching elements that correspond to at least one slit on the circumferential surface of each of the outer tubular sections to maintain the tubular sections in the extended position. In one embodiment, the supporting plate has an integral handle to facilitate handling of the toy air gun and/or a sight to facilitate aiming of the toy air gun.

BRIEF DESCRIPTION OF THE DRAWINGS

A preferred embodiment of the present invention has been chosen for purposes of illustration and description and is shown in the accompanying drawings forming a part of the specification wherein.

DETAILED DESCRIPTION OF THE PREFERRED EMBODIMENTS

Figure 1:
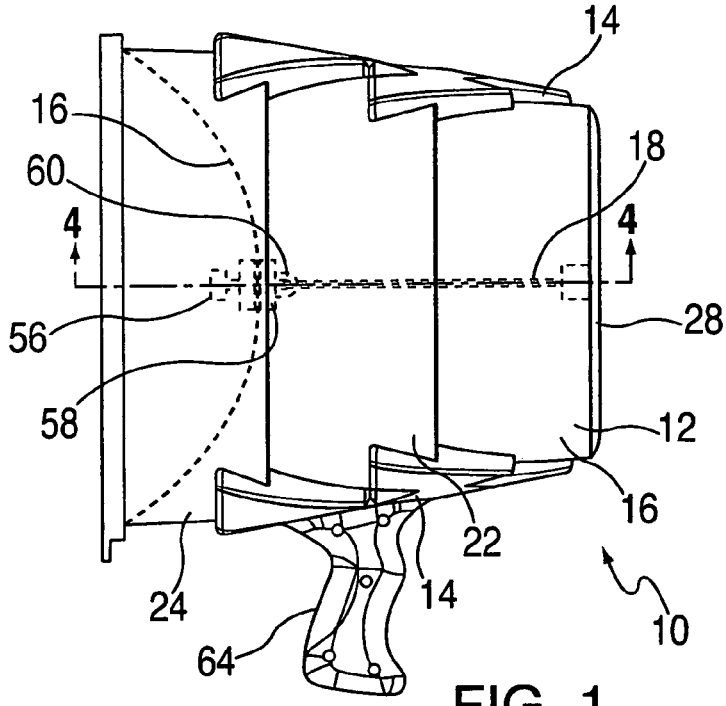
FIG. 1 is side view of the toy air gun of the present invention.

With reference to the drawings, wherein the same reference number indicates the same element throughout, there is shown in FIG. 1 a toy air gun 10 of the present invention. Toy air gun 10 comprises a tapered tubular body 12, two supporting plates 14, a diaphragm 16 and a resilient string 18.

As shown in FIGS. 1–5, tapered tubular body 12 comprises a plurality of tapered tubular sections 20, 22 and 24, which are correspondingly sized and adapted to coaxially connect to form a tapered tubular body 12. Although the toy air gun 10 shown in FIGS. 1–5 includes three tapered tubular sections, a smaller tubular section 20, an interconnecting tubular section 22 and a larger tubular section 24, more or less interconnecting tubular sections 22 may be added or subtracted without detracting from the spirit of the present invention.

Figure 5:
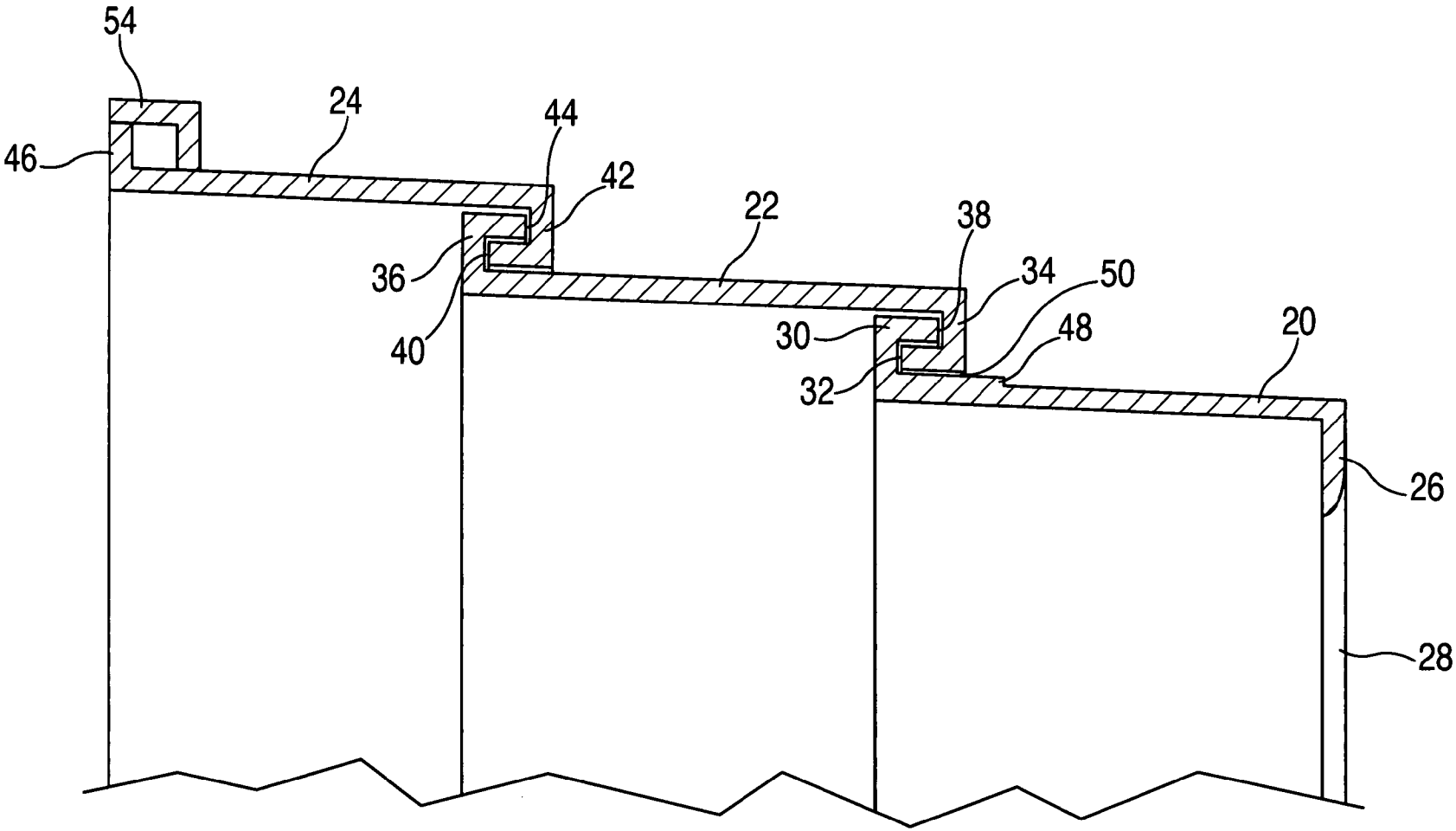
FIG. 5 is an enlarged view of a portion of the toy air gun shown in FIG. 4 illustrating the interconnection of the tapered tubular sections.

As shown in details in FIG. 5, the tubular sections 20, 22 and 24 interlock, in the extended co-axially operational position, to form tapered tubular body 12 having a total axial length of substantially the combined axial lengths of the three tubular sections 20, 22 and 24. In the collapsed position, the toy air gun 10 can be shipped compactly with an axial length of one of the tubular sections 20, 22 and 24 (not shown), with each tubular section 20, 22 and 24 concentrically arranged.

Smaller outer tubular section 20 has at one end a rim 26 extending radially inward to form a muzzle opening 28 of the toy air gun 10. At the opposite end of the smaller outer tubular section is an L-shape flange 30 extending radially outward, forming a groove 32. The interconnecting tubular section 22 has two L-shape flanges 34 and 36, the first extending radially outward at the larger diameter end and the latter extending radially inward at the smaller diameter end, forming grooves 38 and 40, respectively. The larger tubular section 24 has an L-shape flange 42 extending radially inward at the smaller diameter end, forming a groove 44. At the larger diameter end of the larger tubular section 24 is a radially extending rim 46.

In the extended position, the groove 32 correspondingly mates with the free end of flange 34, the groove 38 correspondingly mates with the free end of flange 30, and the groove 40 correspondingly mates with the free end of flange 42. Each of these three groove-flange interlock is held together by friction.

To facilitate the assembly of the three tubular sections 20, 22 and 24 into the extended operational position, at least one axially linear protrusion 48 may provided on the circumferential surface of smaller tubular section 20 and at least one corresponding channel 50 along the L-shape flange 34 of the interconnecting tubular section 22 to guide in the proper alignment of the three tubular sections 20, 22 and 24. A similar combination of protrusion 48 and channel 50 may be provided on the circumferential surface of the interconnecting tubular section 22 and the L-shape flange 42 of the larger tubular section 24 (not shown).

Figure 4:
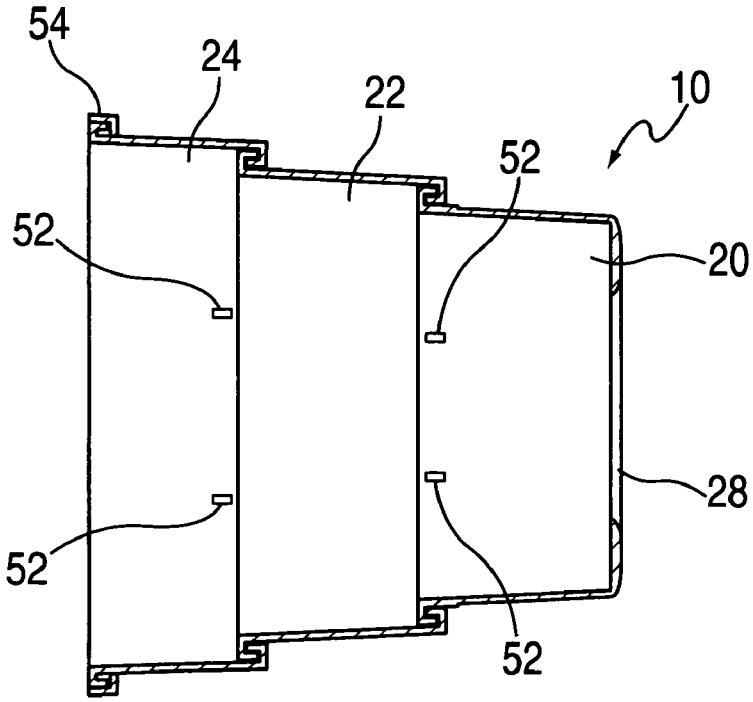
FIG. 4 is a cross-sectional view taken across line 4—4 of FIG. 1, without the diaphragm and resilient string for a more simplified view.

As shown in FIG. 4, along the circumferential surfaces of smaller tubular section 20 and larger tubular section 24 are a plurality of slits 52 for receiving supporting plate 14 to maintain the tubular body 12 in the extended position during operation.

Figure 2:
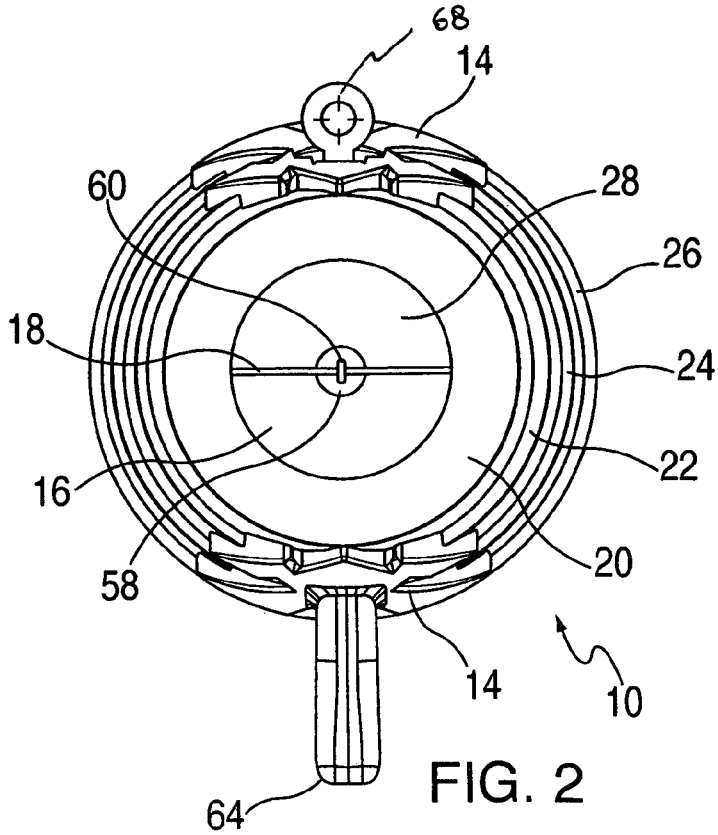
FIG. 2 is a front elevational view.
Figure 3:
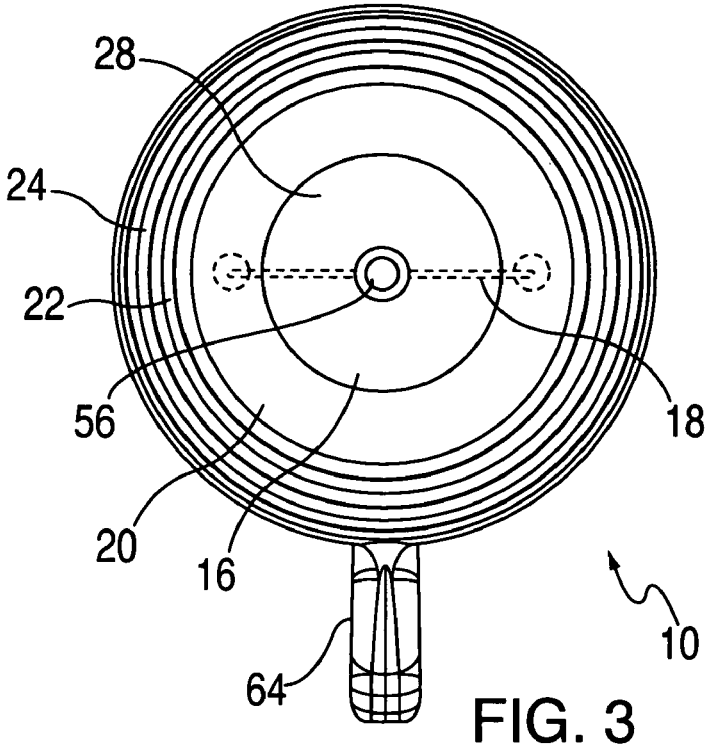
FIG. 3 is a rear elevational view.
Figure 8:
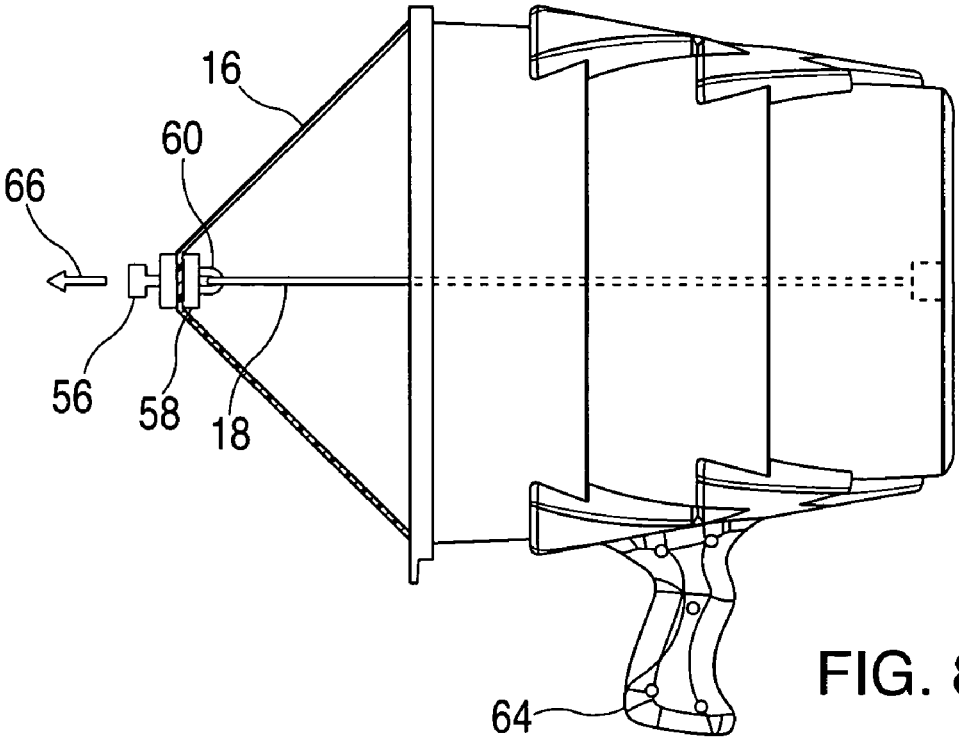
FIG. 8 is a side view of the toy air gun with the diaphragm in a position to shoot a ball of air.

As shown in FIGS. 1–3, with the diaphragm 16 at rest, diaphragm 16 is mounted transversely across the larger end of larger tubular section 24, secured in place by ledge 54. The diameter of the diaphragm 16 is preferably larger than the diameter of the larger end of larger tubular section 24 such that diaphragm 16 extends beyond the confine of the tapered tubular body 12 in preparation of firing a ball of air as shown in FIG. 8. Diaphragm 16 is preferably made of a non-resilient and non-porous material such as thick plastic.

A pull knob 56 and a back support 58 securely sandwich the diaphragm 16 near the center of the diaphragm 16. The back support 58 has an opening 60 wherein the resilient string 18 is looped through. The two ends of the resilient string 18 are securely mounted diametrically across from each other on the rim 26 of smaller tubular section 20.

Figure 6:
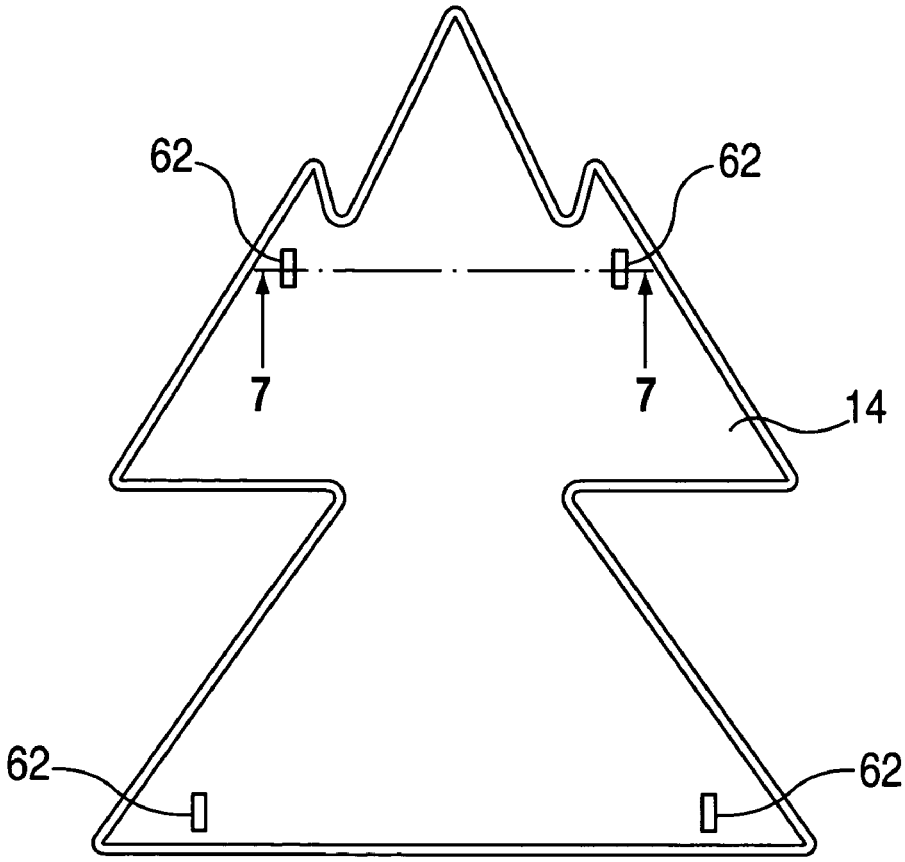
FIG. 6 is a bottom plan view of a supporting plate of the present invention.
Figure 7:
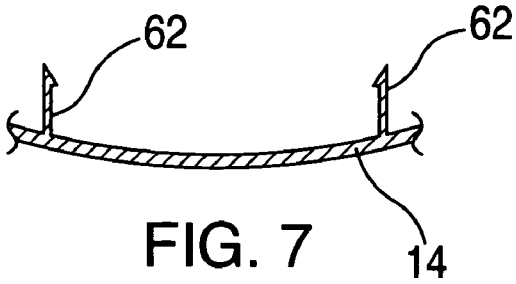
FIG. 7 is a cross section view taken across line 7—7 of FIG. 6 illustrating the latching elements.

As shown in FIGS. 6 and 7, supporting plate 14 is correspondingly curved to rest on the circumferential surface of the tubular body 12. On the concave surface of the supporting plate 14 is a plurality of latching elements 62 that are corresponding located to latch onto slits 52 on the smaller and larger tubular sections 20 and 24 in the extended position. Alternative to the latching elements 62 and slits 52 combination, screws and/or nuts and bolts may be used to secure the supporting plate 14 to the tubular body 12 (not shown).

As shown in FIG. 1–3, two supporting plates 14 are diametrically located to evenly support the tubular body 12. However, one supporting plate 14 may be sufficient. Shown attached to one of the supporting plate 14 is a handle 64 to facilitate the firing of the toy air gun 10.

FIG. 8 shows the toy air gun 10 in a position to shoot a ball of air. A user may use one hand to grasp the handle 64 and the other hand to pull the pull knob 56 in the direction 66 away from tubular body 12, stretching the diaphragm 16 to a rearward position. When the pull knob 56 is released, the diaphragm 16 abruptly springs forward and causes the air in the confine of the tubular body 12 to be propelled through the muzzle opening 28. The tapered tubular body 12 acts as a compression chamber and compress air from the larger diameter end to the smaller diameter end to cause the air to shoot from the toy air gun 10 at a relatively high velocity.

Optionally, a sight 68 may be provided on the supporting plate 14 opposite the supporting plate with a handle 64 (as shown in FIG. 2 only).

The features of the invention illustrated and described herein is the preferred embodiment. Therefore, it is understood that the appended claims are intended to cover the variations disclosed and unforeseeable embodiments with insubstantial differences that are within the spirit of the claims.

We claim:

1. A collapsible toy air gun extendable for shooting a ball of air, comprising:

a) at least two correspondingly sized tubular sections that concentrically nest in a collapsed position and cooperatively extend to form a co-axial tubular body having first and second openings at opposite ends in the extended position;

b) a diaphragm mounted on said tubular body transversely across said first open end of said tubular body;

c) means for pulling said diaphragm rearwardly away from said tubular body; and d) means for springing said diaphragm forward toward said second open end to push air within said tubular body in front of said diaphragm to exit through said second open end.

2. The toy air gun of claim 1 wherein said tubular sections are tapered to form a tapered tubular body having a first larger open end and a second smaller open end.

3. The toy air gun of claim 1, wherein said diaphragm is made of a non-resilient and non-porous material.

4. The toy air gun of claim 1, wherein said pulling means comprises a pull knob and a back support sandwiching said diaphragm near the center of said diaphragm.

5. The toy air gun of claim 1, wherein the diameter of said diaphragm is larger than the diameter of said first open end of said tubular body.

6. The toy air gun of claim 1, wherein said springing means comprises a resilient string having an intermediate portion and two ends, said two ends being secured diametrically and adjacent said second open end of said tubular body and said intermediate portion being connected to said pulling means.

7. The toy air gun of claim 4, wherein said back support further comprises an opening in cooperation with said springing means to push air within said tubular body to exit through said second open end.

8. The toy air gun of claim 1 further comprises a handle attached to said tubular body.

9. The toy air gun of claim 1 further comprises a ledge for securing said diaphragm to said first open end of said tubular body.

10. The toy air gun of claim 1 further comprises a sight attached to said supporting means.

11. A collapsible toy air gun extendable for shooting a ball of air, comprising:

a) at least two correspondingly sized tubular sections that cooperatively co-axially form a tubular body having first and second openings at opposite ends in the extended position;

b) a diaphragm mounted on said tubular body transversely across said first open end of said tubular body;

c) means for pulling said diaphragm rearwardly away from said tubular body;

d) means for springing said diaphragm forward toward said second open end to push air forward of said diaphragm within said tubular body to exit through said second open end; and e) means for supporting said tubular sections in the extended position.

12. The toy air gun of claim 11 wherein said supporting means comprises at least one plate having a curvature corresponding to said tubular body, and at least one latching element on each of said plate for attaching to said at least two tubular sections.

13. The toy air gun of claim 12 further comprises at least one slit on the circumferential surface of each tubular section to receive said at least one latching element.

14. The toy air gun of claim 11 further comprises a handle attached to said supporting means.

15. A collapsible toy air gun for expelling a shot of air, comprises:

a) a first tapered tubular section having a small end and a large end;

b) a second tapered tubular section having a small end and a large end, being larger in diameter than said first tubular section;

c) at least one interconnecting tapered tubular section having a small end and a large end, with said small end of said interconnecting tapered tubular section cooperatively connected to said large end of said first tapered tubular section and said large end of said interconnecting tapered tubular section cooperatively connected to said small end of said second tapered tubular section;

d) wherein said first, interconnecting and second tapered tubular sections form a co-axial tapered tubular body having a larger open end and a smaller open end;

e) a diaphragm mounted on said tubular body transversely across said larger open end of said tubular body;

f) means for pulling said diaphragm rearward away from said tubular body; and g) means for springing said diaphragm forward toward said smaller open end to push and compress air within said tubular body so that the air is propelled out through said smaller open end.

16. The toy air gun of claim 15 further comprises a rim extending radially inward from said small end of said first tapered tubular section to form a muzzle opening.

17. The toy air gun of claim 16 further comprises:

an L-shape flange extending radially outward from each of said large ends of said first tapered tubular section and said interconnecting tapered tubular section, forming first and second grooves, an L-shape flange extending radially inward from each of said small ends of said interconnecting tapered tubular section and said second tapered tubular section, forming third and fourth grooves, said first and second grooves correspondingly mate with said radially inward extending flanges of said interconnecting tubular section and said second tubular section, respectively, and said third and fourth grooves correspondingly mate with said radially outward extending flanges of said first tubular section and said interconnecting tubular section, respectively.

18. The toy air gun of claim 17 further comprises at least one axially linear protrusion on the circumferential surface of said first tubular section and at least one corresponding channel on said inwardly extending L-shaped flange of said interconnecting tubular section.

19. The toy air gun of claim 17 further comprises at least one axially linear protrusion on the circumferential surface of said interconnecting tubular section and at least one corresponding channel on said inwardly extending L-shaped flange of said second tubular section.

20. The toy air gun of claim 15 further comprises means for supporting said tapered tubular sections in the extended position.

21. The toy air gun of claim 20 wherein said support means comprises at least one plate having a curvature corresponding to said tapered tubular body, and at least one latching element on each of said plate for attaching to said first tubular section and to said second tubular section.

22. The toy air gun of claim 15, wherein said pulling means comprises a pull knob and a back support sandwiching said diaphragm near the center of said diaphragm.

23. The toy air gun of claim 15, wherein the diameter of said diaphragm is larger than the diameter of said larger open end of said tapered tubular body.

24. The toy air gun of claim 15, wherein said springing means comprises a resilient string having an intermediate portion and two ends, said two ends being secured diametrically and adjacent said small end of said first tubular body and said intermediate portion being connected to said pulling means.

25. The toy air gun of claim 22, wherein said back support further comprises an opening in cooperation with said springing means to push and compress air within said tubular body so that the air is propelled out through said small end of said first tubular section.

26. The toy air gun of claim 21, further comprises at least one slit on the circumferential surface on each of said first tubular section and said second tubular section to receive said at least one latching element.

27. The toy air gun of claim 15 further comprises a handle attached to said tubular body.

28. The toy air gun of claim 20 further comprises a handle attached to said supporting means.

29. The toy air gun of claim 15 wherein said diaphragm is made of a non-resilient and non-porous material.

30. The toy air gun of claim 15 further comprises a ledge for securing said diaphragm to said larger open end of said tubular body.

31. The toy air gun of claim 15 further comprises a sight attached to said supporting means.

* * * * *